US007377863B2

(12) United States Patent
Sullivan et al.

(10) Patent No.: US 7,377,863 B2
(45) Date of Patent: May 27, 2008

(54) MULTI-LAYER GOLF BALL HAVING IMPROVED INTER-LAYER ADHESION VIA INDUCTION HEATING

(75) Inventors: Michael J. Sullivan, Barrington, RI (US); Derek A. Ladd, Acushnet, MA (US)

(73) Assignee: Acushnet Company, Fairhaven, MA (US)

( * ) Notice: Subject to any disclaimer, the term of this patent is extended or adjusted under 35 U.S.C. 154(b) by 202 days.

(21) Appl. No.: 11/028,054

(22) Filed: Jan. 3, 2005

(65) Prior Publication Data

US 2006/0148590 A1 Jul. 6, 2006

(51) Int. Cl.
*A63B 37/06* (2006.01)

(52) U.S. Cl. ..... 473/368

(58) Field of Classification Search ..... 473/378, 473/368, 367

See application file for complete search history.

(56) References Cited

U.S. PATENT DOCUMENTS

| | | | | |
|---|---|---|---|---|
| 3,236,895 | A | 2/1966 | Lee et al. | 260/584 |
| 3,654,370 | A | 4/1972 | Yeakey | 260/584 B |
| 5,003,107 | A | 3/1991 | Zimmerman et al. | 564/475 |
| 5,015,773 | A | 5/1991 | Dobson | 564/474 |
| 5,252,652 | A | 10/1993 | Egashira et al. | 524/392 |
| 5,334,673 | A | 8/1994 | Wu | 273/235 |
| 5,484,870 | A | 1/1996 | Wu | 528/28 |
| 5,697,856 | A | 12/1997 | Moriyama et al. | 473/374 |
| 5,783,293 | A | 7/1998 | Lammi | 428/212 |
| 5,816,944 | A | 10/1998 | Asakura et al. | 473/372 |
| 5,837,183 | A | 11/1998 | Inoue et al. | 264/403 |
| 6,056,844 | A | 5/2000 | Guiles et al. | 156/272.4 |
| 6,103,166 | A | 8/2000 | Boehm et al. | 264/250 |
| 6,139,447 | A | 10/2000 | Ohama | 473/378 |
| 6,142,887 | A | 11/2000 | Sullivan et al. | 473/374 |
| 6,162,135 | A | 12/2000 | Bulpett et al. | 473/373 |
| 6,184,301 | B1 | 2/2001 | Shindo et al. | 525/261 |
| 6,342,019 | B1 | 1/2002 | Boehm et al. | 473/378 |
| 6,440,346 | B1 | 8/2002 | Wai et al. | 264/254 |
| 6,465,578 | B1 | 10/2002 | Bissonnette et al. | 525/261 |
| 6,495,633 | B1 | 12/2002 | Sullivan | 473/372 |
| 6,506,851 | B2 | 1/2003 | Wu | 525/415 |
| 6,525,141 | B2 | 2/2003 | Kataoka | 525/261 |
| 6,585,607 | B2 | 7/2003 | Tzivanis et al. | 473/371 |
| 6,595,874 | B2 | 7/2003 | Sullivan et al. | 473/374 |
| 6,605,243 | B1 | 8/2003 | Masutani | 264/278 |
| 6,612,940 | B1 * | 9/2003 | Nesbitt et al. | 473/376 |
| 6,648,776 | B1 | 11/2003 | Boehm et al. | 473/374 |
| 6,733,364 | B2 | 5/2004 | Griffiths | 451/5 |
| 6,761,846 | B2 | 7/2004 | Murphy | 264/219 |
| 2002/0132915 | A1 | 9/2002 | Pantone et al. | 524/589 |
| 2002/0173382 | A1 | 11/2002 | Sullivan | 473/373 |
| 2003/0013549 | A1 | 1/2003 | Rajagopalan et al. | 473/354 |
| 2003/0027667 | A1 | 2/2003 | Sullivan | 473/378 |
| 2003/0064826 | A1 | 4/2003 | Voorheis et al. | 473/367 |
| 2003/0096936 | A1 | 5/2003 | Wu et al. | 528/76 |
| 2003/0114247 | A1 | 6/2003 | Cavallaro et al. | 473/357 |
| 2003/0144087 | A1 | 7/2003 | Rajagopalan et al. | 473/371 |

(Continued)

*Primary Examiner*—Raeann Trimiew
(74) *Attorney, Agent, or Firm*—Mandi B. Milbank

(57) ABSTRACT

This invention is directed to golf balls having at least two adjacent layers, wherein a coating layer of metal materials is on at least one surface of the adjacent layers. The adhesion of the adjacent layer is improved by induction heating. The invention also is directed to ink solution for golf equipment comprising metal materials that can improve adhesion of the ink to the golf equipment.

2 Claims, 6 Drawing Sheets

U.S. PATENT DOCUMENTS

2003/0158352 A1 8/2003 Rajagopalan et al. ..... 525/452
2003/0181260 A1 9/2003 Rajagopalan et al. ..... 473/354
2003/0191246 A1 10/2003 Morgan et al. ..... 525/237
2004/0010096 A1 1/2004 Rajagopalan et al. ..... 525/453
2004/0219995 A1 11/2004 Sullivan ..... 473/371
2004/0235587 A1 11/2004 Sullivan et al. ..... 473/371

* cited by examiner

MULTI-LAYER GOLF BALL HAVING IMPROVED INTER-LAYER ADHESION VIA INDUCTION HEATING

FIELD OF THE INVENTION

This invention is related to multi-layer golf balls, wherein the adhesion between at least two adjacent layers is improved by induction heating.

BACKGROUND OF THE INVENTION

Conventional golf balls include multi-layer balls, which may have one or more wound layers. The difference in playing characteristics is significant among the three different types of balls: two-piece balls, wound balls and multi-layer balls. Two-piece balls are typically made with a single solid core encased by a cover material. These balls are generally most popular among recreational golfers, because they are durable and provide maximum distance. Typically, the solid core is made of polybutadiene chemically cross-linked with zinc diacrylate and/or similar cross-linking agents. The cover material comprises tough, cut-proof blends of one or more ionomers, such as SURLYN® sold commercially by DuPont or IOTEK® sold commercially by Exxon.

Wound balls typically have either a solid rubber or liquid-filled center, around which many yards of a stretched elastic thread or yarn are wound to form a core. The wound core is then covered with a durable ionomer cover, or a softer cover such as balata or polyurethane. Wound balls are generally softer than two-piece balls and can provide more spin, thus enabling skilled golfers to have more control over the ball's flight and placement.

Solid multi-layer golf balls may have one or more core layers, one or more intermediate layers and one or more cover layers. They are designed to overcome some of the undesirable features of conventional two-piece balls, such as hard feel, while maintaining the positive attributes of wound balls, such as increased initial velocity and distance. It is also desirable that multi-layer balls have similar "click and feel" and spin characteristics of wound balls.

Solid multi-layer golf balls can be produced using a variety of manufacturing techniques. For example, two or more cover layers may be molded around a conventional core with one or more intermediate layers interposed between the cover layers and the core. Alternatively, multi-layer balls may be formed from cores having more than one core layers and may optionally contain one or more intermediate and/or cover layers. Multi-layer balls may even comprise a conventional wound core around which at least one intermediate layer and/or at least one cover layer are formed. Typically, the outer layers of multi-layer golf balls are formed by molding them around the core or the preceding intermediate layer or cover layer. Conventional techniques for applying such layers include injection molding, compression molding and casting the layer material around the preceding core or layer.

It is desirable to obtain good adhesion between the various solid layers. If the adhesion between the layers is not acceptable, the performance or durability of the golf ball can be adversely affected. For example, poor adhesion can cause unattached areas to form between the layers that can result in separation of the layers when the ball is struck with a club. It is also known that the adhesion between the wound layer and the encasing layer can be improved when the encasing material flows into the voids among the windings during the molding process, resulting in improved adhesion.

The patent literature discloses a number of references teaching improved adhesion techniques. U.S. Pat. Nos. 6,103,166, 6,342,019, and 6,648,776 to Boehm et al., which are incorporated by reference in their entireties, relate to using textured surface profile that are integrally molded to the outer surface to improve adhesion between golf ball layers. The surface profile comprises peaks having heights between about 2 mils and about 15 mils.

U.S. Pat. No. 6,440,346 to Wai et al. relates to a golf ball comprising a core having outwardly extending projections, and an interstitial space layer of relatively less resilient material applied in the interstitial space between the projections on the surface of the core. A cover is then applied over the core and the interstitial space layer.

U.S. Pat. No. 6,605,243 to Masatani relates to a method of producing golf ball comprising a spherical elastic inner layer having outwardly extending projections with either round or polygonal shapes, and a thermoplastic resin outer layer covering the inner layer.

U.S. Pat. No. 6,761,846 to Murphy relates to a method of making a golf ball with an interior layer having outwardly extending protrusions to facilitate adhesion to the cover materials.

U.S. Pat. No. 5,837,183 to Inoue et al. relates to a method of molding golf ball comprising the steps of providing a thin film layer of a magnetic material on the inside surface of a spherical cavity of a mold, embedding an induction heating coil and a cooling channel beneath the magnetic material in the mold, generating a magnetic field via a high frequency oscillator to heat the cavity, introducing a predetermined amount of a molten stock material to fill the cavity, and feeding a coolant via the cooling channel to complete the molding process.

U.S. Pat. No. 6,585,607 to Tzivanis et al. relates to a process to increase adhesion between two adjacent layers in a golf ball comprising the steps of roughening the bonding surface of one layer, chlorinating the roughened surface, treating the surface of adjacent layer with a silicone-based adhesion promoter, and joining the layers.

However, there remains a need to improve interlayer adhesion in the process of making multi-layer golf balls.

SUMMARY OF THE INVENTION

This invention is directed to a multi-layer golf ball comprising at least two layers, and one of the layers comprises a plurality of susceptors. The susceptors when exposed to induction heating improve the adhesion between the layers. The susceptors are preferably metals, more preferably magnetic and most preferably ferromagnetic materials. Suitable susceptors include iron, iron-containing compounds, cobalt nickel, strontium, gadolinium, $SrFe_{12}O_{19}$, $Co_2Ba_2Fe_{12}O_{22}$, $Fe_3O_4$ (44 micron), $Fe_3O_4$ (840 micron), $Fe_2O_3$, iron base steel stocks (e.g. S45C, and S55C) and prehardened steel stocks (e.g. NAK steel). The layers containing susceptors may further comprise non-magnetic fillers, fibers, flakes, filaments, metal, ceramic, graphite, glass, boron, or Kevlar.

The susceptors can be in the form of a continuous polygonal mesh, such as triangle, square, pentagon, hexagon, and quadrilateral. In addition, the susceptors can be in the form of discrete fillers, short fibers, long fibers, flakes, spheres, microparticles, nanoparticles, nanotubules, or nanocapsules.

In one embodiment, the susceptors are mixed with a thermoplastic polymeric matrix, or a thermosetting polymeric matrix. The mixture can be applied to at least one surface of the adjacent layers before induction heating is applied.

In another embodiment, the susceptors are added to a castable layer, such as polyurea, polyurethane or a staged resin film or material, before induction heating is applied to cure the castable layer. Furthermore, the susceptors can be added to a layer adjacent to the castable layer before induction heating is applied to indirectly cure the castable layer.

In another embodiment, the golf ball comprises a thermoplastic layer containing a heat-reactive material and susceptors. The heat-reactive material reacts with itself or with the thermoplastic layer upon the induction heating. Alternatively, a moisture barrier layer containing susceptors is formed between the cover layer and the core layer, which is cured by induction heating. Furthermore, due to the relatively high specific gravity of some ferromagnetic susceptors, the susceptors can form a portion of a thin dense layer of a perimeter-weighted golf ball.

In a different aspect, the invention is directed to an ink solution comprising susceptors. The ink can be applied to sports equipment, such as game balls, golf ball, golf club, golf glove, golf shoe, golf bag, and golf accessories.

DETAILED DESCRIPTION OF THE INVENTION

Figure 1A:
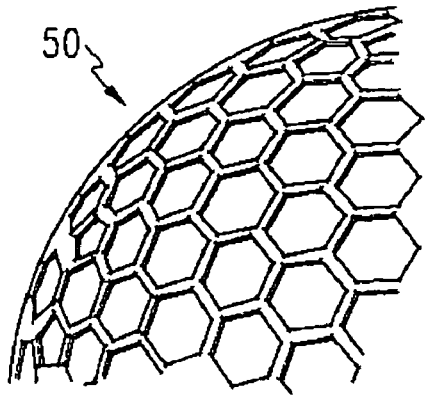
FIGS. 1(*a*)-1(*h*) illustrate a continuous or screen mesh made from susceptors.
Figure 1B:
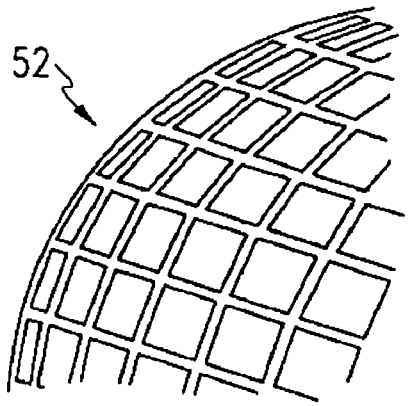
Figure 1C:
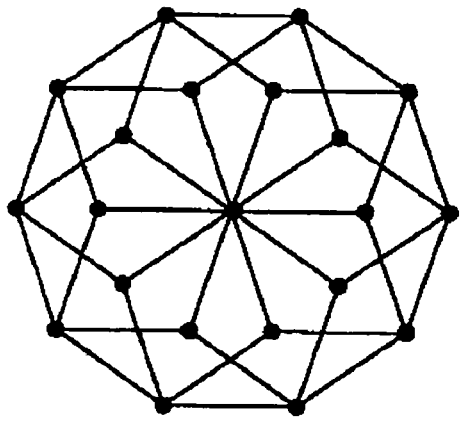
Figure 1D:
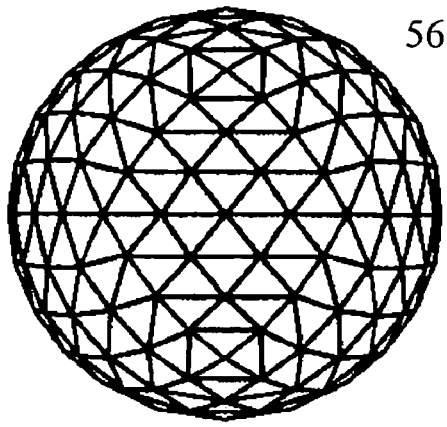
Figure 1E:
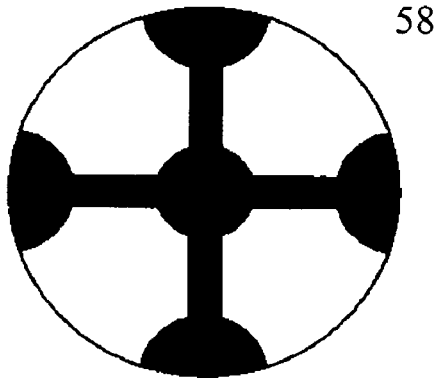
Figure 1F:
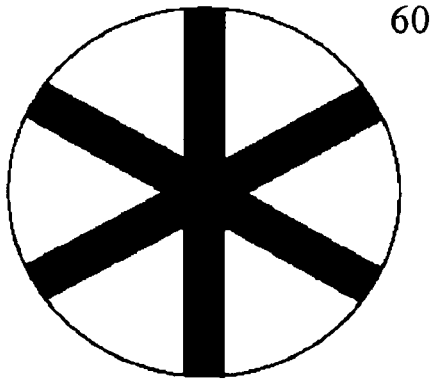
Figure 1G:
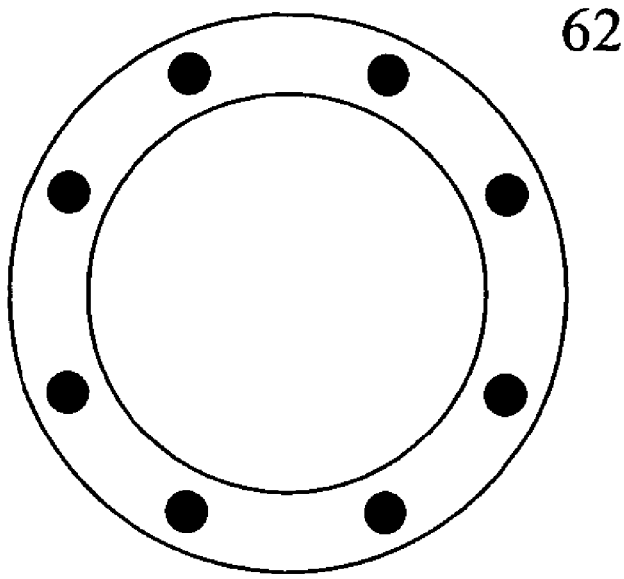
Figure 1H:
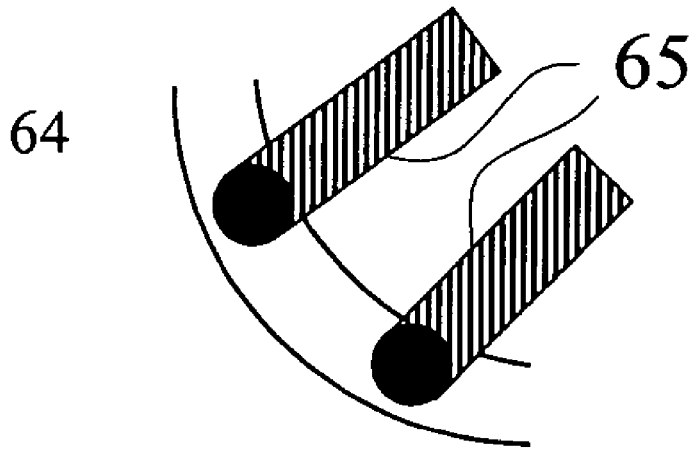

The present invention is directed to a multi-layer golf ball having one or more core layers, one or more intermediate layers, and/or one or more cover layers, wherein at least one layer contains a metal material ("MM"), and wherein the adhesion between two adjacent layers is improved via induction heating ("IH") of the MM. The present invention is also directed to the selective use of MM in golf ball core and/or cover layers to allow for temperature-controlled IH for adhering or bonding, cross-linking, improving durability, etc. as outlined herein. An alternative embodiment is directed to an ink indicia comprising MM for improved durability via a printing of the mark on golf balls or golf equipment.

The basic components of an IH system comprise an induction coil connected to an alternating current ("AC") source, and a work piece that is to be heated. The induction coil generates a magnetic field surrounding the work piece that contains MM susceptors. The magnetic field induces eddy currents in the MM susceptors within the work piece, and thus resulting in fast, clean, localized and consistent heating without physical contact between the coil and the work piece. See U.S. Pat. No. 6,056,844 to Guiles et al. and "Ameritherm Inc.'s Induction Heating Applications and Equipment Selection Guide" at www.ameritherm.com and web pages contained therein ("Ameritherm"), both of which are incorporated by reference in their entireties.

When IH is applied to a work piece, the frequency of the AC in the induction coil is inversely proportional to the depth that the magnetic field penetrates the work piece. For example, low AC frequencies of about 5 KHz to about 30 KHz are effective for heating relatively thicker materials. Higher AC frequencies of about 100 KHz to about 400 KHz are effective to penetrate smaller or shallower parts. AC frequencies of up to about 60 MHz are suitable for microscopic parts.

IH can be applied to work pieces that are made of magnetic or electrically conductive materials. To apply IH to non-conductive or plastic work pieces, susceptors made of conductive metal materials can be used to transfer heat by conduction or radiation to the non-conductive or plastic work pieces. Different conductive metal materials react differently to induced electric current. For instance, because carbon, steel, tungsten and tin have relatively high electrical resistivities, these materials can be heated more quickly than those materials with low electrical resistivities.

According to their characteristics under a magnetic field, the MM can be further divided into diamagnetic, paramagnetic and ferromagnetic materials. Diamagnetic materials such as copper, silver, and gold have weak and negative susceptivitiy toward magnetic forces. They are slightly repelled by a magnetic field and do not retain any magnetic property once the magnetic field is removed. See "Diamagnetic, Paramagnetic, and Ferromagnetic Materials," available at http://www.ndt-ed.org/EducationResources/CommunityCollege/MagParticle/Physics/MagneticMatls.htm. Paramagnetic materials such as magnesium, molybdenum, lithium and tantalum have small and positive susceptivity toward magnetic forces. Paramagnetic materials are slightly attracted to a magnetic field but do not retain any magnetic property once the magnetic field is removed. Ferromagnetic materials ("FMMs") such as iron, nickel and cobalt have high susceptivity to magnetic fields and exhibit a strong attraction to magnetic fields. They retain their magnetic properties after the external field is removed.

When applying IH, FMMs are easier to heat than non-magnetic materials, because they naturally resist the rapidly changing magnetic fields produced by the AC within the induction coil. The resulting friction produces heat known as hysteresis heating, in addition to the heat generated by eddy currents. When an FMM is placed in an electromagnetic field, the hysteresis losses in the material cause its temperature to rise, eventually reaching its Curie temperature. Curie temperature is defined as the temperature at which ferromagnetism in an FMM disappears as thermal oscillations overcome the orientation due to exchange interaction, resulting in a random grouping of the atomic particles. Upon reaching its Curie temperature, the material crystal lattice undergoes a dimensional change, causing a reversible loss of magnetic dipoles. Once the magnetic dipoles are lost, the ferromagnetic properties cease, thus halting further heating.

In the present invention, the IH process is applied to improve interlayer adhesion in multi-layer golf balls by optimizing susceptor design, fusion bonding or welding of thermoplastic layers. Preferably, FMMs or other materials amenable to induction heating can be used alone or in conjunction with FMMs. Suitable FMMs are discussed in U.S. Pat. No. 5,837,183 to Inoue et al., and U.S. Pat. No. 6,056,844 to Guiles et al., which are incorporated by reference in their entireties. Examples of suitable FMM include, but are not limited to, $Co_2Ba_2Fe_{12}O_{22}$, $Fe_3O_4$ (44 micron), $Fe_3O_4$ (840 micron), $Fe_2O_3$, $SrFe_{12}O_{19}$, iron, cobalt, nickel, the rare earth elements including lanthanum, cerium, praseodymium, neodymium, promethium, samarium, europium, gadolinium, terbium, dysprosium, holmium, erbium, thulium, ytterbium, and lutetium, the actinide elements including actinium, thorium, protactinium, uranium, neptunium, plutonium, americium, curium, berkelium, californium, einsteinium, fermium, mendelevium, nobelium, lawrencium, iron containing compounds such as iron based steel stocks, e.g. S45C and S55C, and prehardened steel stocks, e.g. NAK steel. In addition, "nanofoam," an allotrope of carbon, is ferromagnetic and can be used as susceptor in the invention. See "Nanofoam Exhibits Surprising Magnetic Properties," available at http://www.pa.msu.edu/~tomanek/publicity/magfoam-14may04.html.

Referring to FIGS. 1(*a*), 1(*b*), 1(*c*), 1(*d*), 1(*e*) 1(*f*), 1(*g*) and 1(*h*), susceptors made of MM can be a continuous network such as a screen mesh positioned between at least two adjacent layers. Alternatively, the MM may be selectively placed within, on or near the surface of a layer subject to induction heating. As shown, the continuous network can be a mesh of polygons, such as hexagons (50), squares (52), quadrilaterals (54), and triangles (56), or a mesh of an interconnected network of circles (58), or a network of meridians (60). The cut away (62) shows the continuous network of MM located within a layer in the golf ball. The expanded view (64) shows the MM as continuous filament or fiber (65). The continuous network can also be a filament fiber that is wound, wrapped, or in the form of a mesh or screen.

Alternatively, the MM susceptors may be present as an intermediate layer with non-uniform thickness, wherein the layer comprises a plurality of outer projections disposed on the outer surface of said intermediate layer. As discussed in U.S. Pat. No. 6,733,364, which is incorporated herein in its entirety, the outer projections may have any shape or profile, including but not limited to, trapezoidal, sinusoidal, dome, dome, stepped, cylindrical, conical, truncated conical, rectangular, pyramidal with polygonal base, truncated pyramidal, polyhedronal, and the like.

Figure 2A:
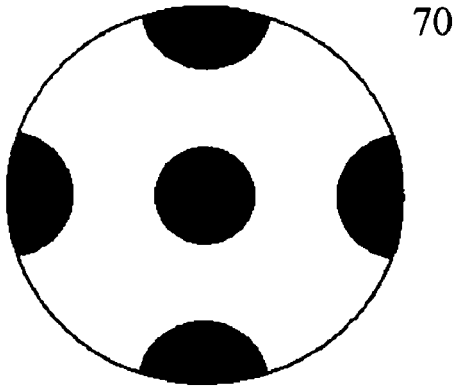
FIGS. 2(*a*)-2(*c*) illustrate discreet placements of susceptors.
Figure 2B:
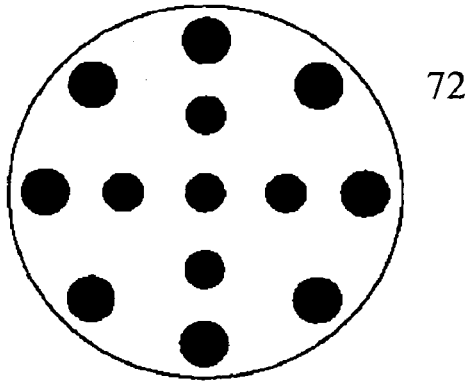
Figure 2C:
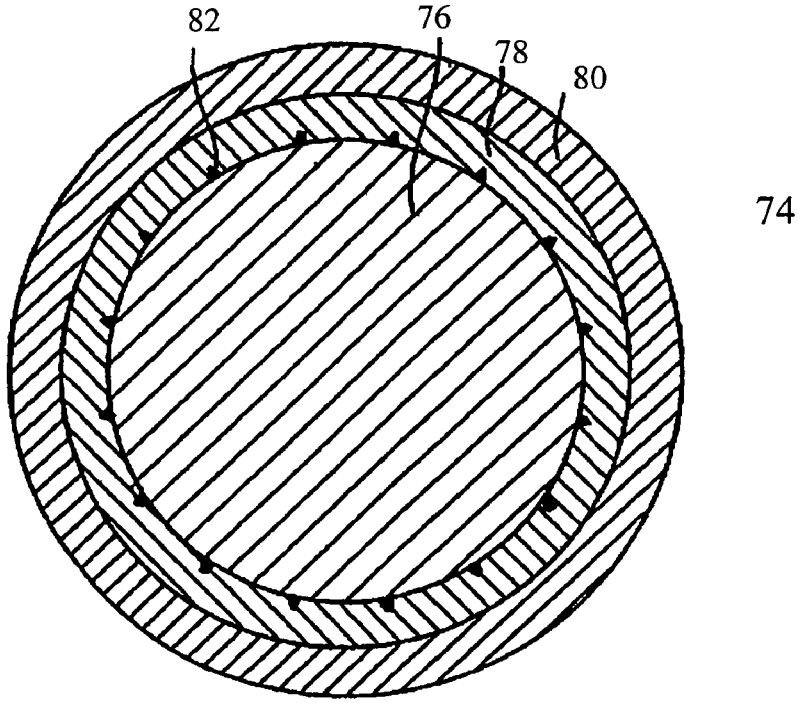
Figure 3A:
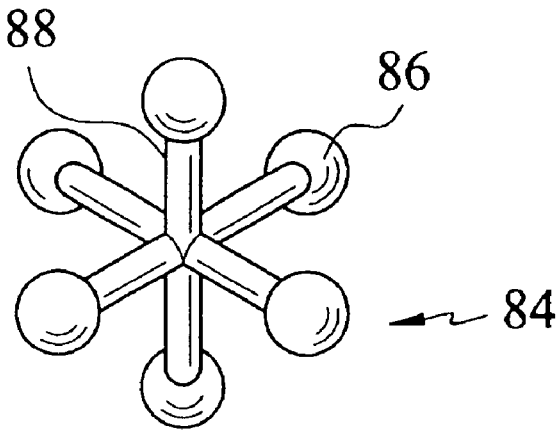
FIGS. 3(*a*)-3(*d*) illustrate examples of metal susceptors.
Figure 3B:
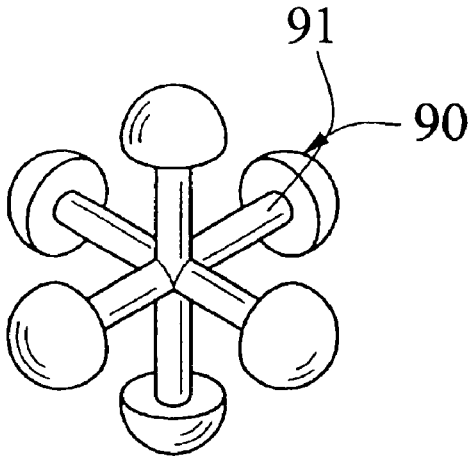
Figure 3C:
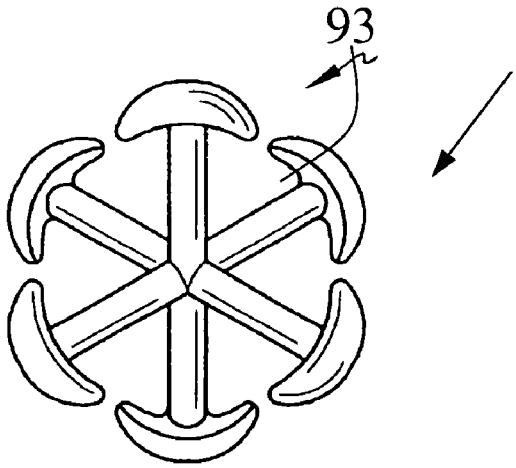
Figure 3D:
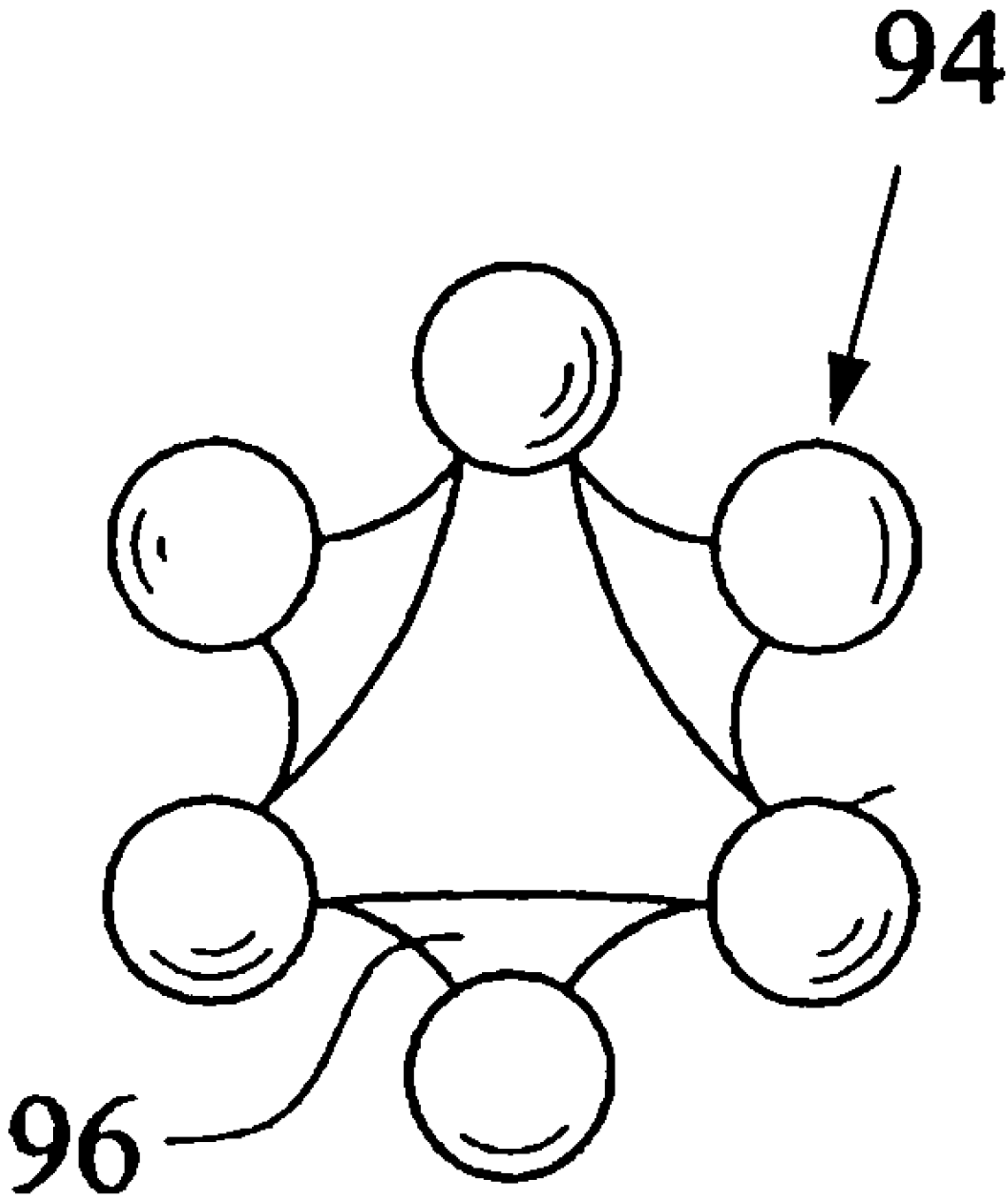

Referring to FIGS. 2(*a*), 2(*b*) and 2(*c*), the MM susceptors can be a discrete network of big circles (70), or small circles (72). MM susceptor (82) is part of a multi-layer ball (74) comprising a core (76), an inner cover (78), and an outer cover (80). The MM susceptors may be located between the inner cover (78) and the core (76). The MM susceptors may be discrete filler, short or long fiber, flake, sphere, micro or nanoparticle, nanotubule, nanocapsule, etc. of uniform or irregular shape.

Referring to FIGS. 3(*a*), 3(*b*), 3(*c*) and 3(*d*), the MM susceptors can be in various shapes. For example, susceptor (84) has a ball (86) and rod (88) construction. In the alternative, a susceptor can be a mushroom (90) and rod (91) configuration, an anchor (92) and rod (93) configuration, or a ball (94) and webbed legs (96) construction. The susceptors in these figures can be embedded into the core.

Any of the embodiments herein may additionally include non-magnetic fillers, fibers, flakes, filaments, metal, ceramic, graphite, glass, boron, Kevlar, etc. such as those of U.S. Pat. Nos. 6,142,887, 6,494,795, 6,595,874, and 5,783,293, which are incorporated herein by reference in their entireties.

Alternatively, a paste, a coating, or an adhesive comprising MM susceptors in a thermoplastic or thermosetting polymeric matrix or carrier may be applied as a thin layer to at least one surface of the adjacent layers and then induction heated to form strong adhesion between adjacent layers.

The same approach is applicable to the curing of thermosetting materials, such as polyurethane or polyurea wherein MM susceptors are added to a castable polymer and then induction heated to thermally cure the polymer. Alternatively, a layer under or over the PU or polyurea may comprise MM susceptors and the PU or polyurea may be cured indirectly via heat transfer from the layer comprising MM susceptors to the PU or polyurea layer. Good adhesion between these layers can improve moisture resistance of the PU or polyurea by providing a non-hygroscopic filler and/or tortuous-path scenario, depending upon the choice of type and morphology of magnetic material employed.

Alternatively, the MM susceptors can also be utilized with multi-layer golf balls having at least one portion that is formed from a partially cured thermosetting resin composition, which is also known as a staged resin film ("SRF"). As described in U.S. Pat. App. Pub. 2003/0027667, which is incorporated herein in its entirety, an SRF includes at least one cross-linkable resin. Examples of cross-linkable resin includes, but are not limited to, polyurethane, polyurea, epoxy, diene rubber, unsaturated polyester, silicone, interpenetrating polymer network, or any combination thereof. The polyurethane and polyurea may be derived from a partially or totally blocked polyisocyanate. The SRF should be flexible enough that it will not readily fracture or degrade from ordinary use. The SRF preferably is in the form of a malleable sheet for ease of handling and processing, and the SRF may be supported by a substrate or fabric from which it can be readily peeled from which it can be readily peeled from just prior to molding over a portion of the golf ball. The substrate or fabric may also remain attached to the SRF and become incorporated into the multi-layer golf ball. In one embodiment, the SRF may be part of a laminate sandwiched between two layers of a cross-linkable, uncured or partially cured sheet of polybutadiene rubber formulation. The SRF can be cured by the heat that can be generated when the MM susceptors in the vicinity is induction heated.

In a separate embodiment, an ink or other coating containing MM susceptors may be used to provide a durable marking for golf balls. For example, the ink is applied in a conventional manner and then is induction heated to cause the marking to become embedded or otherwise firmly locked into the cover or core layer. This can be used for the application of logo or indicia to a thermoplastic cover layer such as an ionomer. In addition, it may also be used with thermoset layers, where there can be a chemical link between the ink and the substrate via a heat induced reaction between the ink and the thermoset substrate. Alternatively, by simply softening the thermoset substrate, a better physical linkage between the ink and the substrate can be achieved. The use of appropriate ink chemistries may facilitate the "sublimation" of the marking into the substrate.

Alternatively, an ink solution can comprise a susceptor, or a plurality of susceptors, and the ink solution can be applied to sports equipment, such as game balls, golf ball, golf club, golf glove, golf shoe, golf bag, and golf accessories. The susceptor improves the adhesion between the ink solution and the sports equipment when induction heating is applied.

In another embodiment, a thermoplastic core or cover component with MM susceptors is further modified with a heat-reactive material, such that when the layer is induction heated it causes the reaction of the pre-embedded or pre-mixed material either with itself or with the thermoplastic material to result in improved cross-linking or polymerization. For example, a polyolefinic polymer is mixed with a high temperature peroxide and any number of coagents (ZDA, TMPTA, etc.) such that there is little or no reaction as the core and/or cover layer is molded but that following molding, the core/cover is induction heated causing a polymerization/cross-linking to occur. Preferably, the polymer has some unsaturation (such as EPDM, PBR, etc.), but it may also be a saturated polymer such as a metallocene catalyzed ethylene copolymer that is susceptible to hydrogen abstraction and subsequent peroxide-initiated cross-linking.

In another embodiment, an MM layer is a moisture barrier layer between core and cover layers, wherein the moisture barrier layer improves adhesion between the layers. Moisture barrier layers are disclosed in U.S. Pat. App. Pub. 2003/0114247 and patent documents cited therein. The moisture barrier layer is preferably applied as a spray, dip, or spin, etc. in a very thin coating or layer so as not to otherwise affect golf ball properties.

In any of these embodiments, where the specific gravity of the magnetic material is high, i.e., greater than about 2.0, such layer may be a thin dense layer. See U.S. Pat. App. Pub. 2002/0173382 and related patent and patent applications, and see U.S. Pat. App. Pub. 2004/0219995 regarding inter-cross-linked layers. The present invention may also be used with any of the selectively weighted golf balls discussed in U.S. Pat. No. 6,595,874.

In one embodiment of the invention, the multi-layer golf ball comprises a core, an intermediate layer, and a cover layer, wherein the golf ball has an overall size of about 1.68 inches to about 1.8 inches. The golf ball has an Atti compression of about 100 or less than about 100, preferably about 40 to about 120.

The core has a diameter from about 0.25 inch to about 1.65 inches, preferably from about 1.25 inches to about 1.65 inches. The core has a hardness of at least about 15 Shore A, preferably about 50 Shore A to about 90 Shore D, and more preferably about 35 Shore D to about 60 Shore D. The core has an Atti compression of 80 or less than 80, preferably about 10 to about 70.

The core may comprise an inner core layer and an outer core layer, wherein the inner core layer has a diameter of about 0.25 inch to about 1.62 inches, preferably about 0.50 inch to about 1.60 inches. The outer core layer has a thickness of at least about 0.1 inch, preferably about 0.10 inches to about 0.8 inch.

The intermediate layer has a thickness of about 0.002 inch to about 0.1 inch, preferably about 0.01 inch to about 0.045 inch. In a different embodiment, the intermediate layer is a moisture barrier layer having a moisture vapor transmission rate that is less than the moisture vapor transmission rate of the cover layer. The intermediate layer has a hardness of about 30 Shore D or greater, preferably about 90 Shore D or less, and more preferably about 55 Shore D to about 65 Shore D.

The cover layer has a thickness of about 0.02 inch to about 0.12 inch, preferably about 0.02 inch to about 0.05 inch. The cover layer has a hardness of about 20 Shore D to about 70 Shore D.

The core of the multi-layer golf ball can be made either from (a) a thermoplastic highly neutralized polymer ("HNP") such as those disclosed in U.S. Pat. App. Pub. 2003/0013549, 2003/0144087, 2003/0158352, and 2003/0181260, and U.S. patent Ser. Nos. 10/882,130, 10/958,000 and 10/959,751, or (b) a thermosetting rubber such as a polybutadiene, ZDA, peroxide, and cis-to-trans catalyst such as a halogenated organosulfur compound, such as those formulations disclosed in, U.S. Pat. No. 6,162,135, U.S. Pat. App. Pub. 2003/0064826, and U.S. application Ser. Nos. 10/882,130 and 10/958,000. These references are incorporated by reference in their entireties.

The thermoplastic HNP, is formed from a reaction between acid groups on a polymer, a suitable source of cation, and an organic acid or the corresponding salt. The suitable source of cation is present in an amount sufficient to neutralize the acid groups on the polymer by at least about 80%. In a preferred embodiment, the acid groups on the polymer may be neutralized by at least about 90%. In another preferred embodiment, the acid groups on the polymer may be neutralized by about 100%.

The HNP may further comprise partially neutralized ionomeric copolymers, ionomeric terpolymers, ionomer precursors, thermoplastics, thermoplastic elastomers, grafted metallocene-catalyzed polymers, non-grafted metallocene-catalyzed polymers, single-site polymers, highly crystalline acid polymers and ionomers thereof, cationic ionomers and mixtures thereof.

Examples of organic acid of the HNP include, but are not limited to, an aliphatic organic acid, an aromatic organic acid, a saturated mono-functional organic acid, a saturated di-functional organic acid, a saturated multi-functional organic acid, an unsaturated mono-functional organic acid, an unsaturated di-functional organic acid, an unsaturated multi-functional organic acid, and a multi-unsaturated mono-functional organic acid.

Suitable cations can be used to neutralize the acid groups of the HNP. Examples of suitable cations include, but are not limited to, barium, lithium, sodium, zinc, bismuth, chromium, cobalt, copper, potassium, strontium, titanium, tungsten, magnesium, cesium, iron, nickel, silver, aluminum, tin, or calcium.

Alternatively, salts of fatty acids can be used to neutralize the organic acids of the HNP. These fatty acids include, but are not limited to, caprioic acid, caprylic acid, capric acid, lauric acid, stearic acid, behenic acid, erucic acid, oleic acid, linoelic acid, or dimerized derivatives thereof. HNPs are discussed in details in commonly owned, co-pending patent application Ser. No. 10/959,751, filed on Oct. 6, 2004, which has been incorporated by reference above.

Thermosetting rubber may, comprise a reaction product of a cis-to-trans catalyst, a resilient polymer component having polybutadiene, a free radical source, and optionally, a cross-linking agent, a filler, or both. Preferably, the polybutadiene reaction product is used to form at least a portion of the core of the golf ball, and further discussion below relates to this embodiment for preparing the core. Preferably, the reaction product has a first dynamic stiffness measured at −50° C. that is less than about 130 percent of a second dynamic stiffness measured at 0° C. More preferably, the first dynamic stiffness is less than about 125 percent of the second dynamic stiffness. Most preferably, the first dynamic stiffness is less than about 110 percent of the second dynamic stiffness.

The cis-to-trans conversion requires the presence of a cis-to-trans catalyst, such as an organosulfur or metal-containing organosulfur compound, a substituted or unsubstituted aromatic organic compound that does not contain sulfur or metal, an inorganic sulfide compound, an aromatic organometallic compound, or mixtures thereof. The cis-to-trans catalyst component may include one or more of the cis-to-trans catalysts described herein. For example, the cis-to-trans catalyst may be a blend of an organosulfur component and an inorganic sulfide component. Suitable organosulfur compounds include those disclosed in U.S. Pat. Nos. 6,525,141, 6,465,578, 6,184,301, 6,139,447, 5,697,856, 5,816,944, and 5,252,652, U.S. App. Pub. 2004/0235587 and U.S. patent application Ser. Nos. 10/882,130 and 10/959,751, the disclosures of which are incorporated by reference in their entireties.

More specifically, suitable organosulfur compounds include, but are not limited to, pentachlorothiophenol, zinc pentachlorothiophenol, magnesium pentachlorothiophenol, cobalt pentachlorothiophenol, pentafluorothiophenol, zinc pentafluorothiophenol, and blends thereof. Preferred candidates are pentachlorothiophenol (available from Strucktol Company of Stow, Ohio), zinc pentachlorothiophenol (available from eChinachem of San Francisco, Calif.), and blends thereof. Another group of suitable organosulfur compounds are organic disulfides which include, without limitation, perhalogenated (i.e., fully halogenated) organic disulfides and organometallic disulfides. Perhalogenated compounds are preferably perfluorinated, perchlorinated, and/or perbrominated. Perhalogenated organic disulfides include perhalogenated derivatives of any and all organic disulfides known and/or available to one skilled in the art, which include those disclosed herein, such as ditolyl disulfides, diphenyl disulfides, quinolyl disulfides, benzoyl disulfides, and bis(4-acryloxybenzene)disulfide, among others. A particular example is perchloroditolyl disulfide. Organometallic disulfides include combinations of any metal cations disclosed herein with any organic disulfides disclosed herein. A particular example is zinc ditolyl disulfide.

The organosulfur cis-to-trans catalyst, when present, is preferably present in an amount sufficient to produce the reaction product so as to contain at least about 12 percent trans-polybutadiene isomer, but typically is greater than about 32 percent trans-polybutadiene isomer based on the total resilient polymer component. In another embodiment, metal-containing organosulfur components can be used according to the invention. Suitable metal-containing organosulfur components include, but are not limited to, cadmium, copper, lead, and tellurium analogs of diethyldithiocarbamate, diamyldithiocarbamate, and dimethyldithiocarbamate, or mixtures thereof. Additional suitable examples of can be found in commonly owned and co-pending U.S. Pat. App. Pub. 2003/0191246.

Suitable substituted or unsubstituted aromatic organic components that do not include sulfur or a metal include, but are not limited to, 4,4'-diphenyl acetylene, azobenzene, or a mixture thereof. The aromatic organic group preferably ranges in size from $C_6$ to $C_{20}$, and more preferably from $C_6$ to $C_{10}$. Suitable inorganic sulfide components include, but are not limited to titanium sulfide, manganese sulfide, and sulfide analogs of iron, calcium, cobalt, molybdenum, tungsten, copper, selenium, yttrium, zinc, tin, and bismuth.

The cis-to-trans catalyst can also include a Group VIA component. Elemental sulfur and polymeric sulfur are commercially available from, e.g., Elastochem, Inc. of Chardon, Ohio. Exemplary sulfur catalyst compounds include PB(RM-S)-80 elemental sulfur and PB(CRST)-65 polymeric sulfur, each of which is available from Elastochem, Inc. An exemplary tellurium catalyst under the trade name TELLOY and an exemplary selenium catalyst under the tradename VANDEX are each commercially available from RT Vanderbilt.

A free-radical source, often alternatively referred to as a free-radical initiator, is required in the composition and method. The free-radical source is typically a peroxide, and preferably an organic peroxide. Suitable free-radical sources include di-t-amyl peroxide, di(2-t-butyl-peroxyisopropyl) benzene peroxide, 3,3,5-trimethyl cyclohexane, a-a bis(t-butylperoxy) diisopropylbenzene, 1,1-bis(t-butylperoxy)-3,3,5-trimethylcyclohexane, dicumyl peroxide, di-t-butyl peroxide, 2,5-di-(t-butylperoxy)-2,5-dimethyl hexane, n-butyl-4,4-bis(t-butylperoxy)valerate, lauryl peroxide, benzoyl peroxide, t-butyl hydroperoxide, and the like, and any mixture thereof.

A cross-linking agent is included to increase the hardness of the reaction product. Suitable cross-linking agents include one or more metallic salts of unsaturated fatty acids or monocarboxylic acids, such as zinc, aluminum, sodium, lithium, nickel, calcium, or magnesium acrylate salts, and the like, and mixtures thereof. Preferred acrylates include zinc acrylate, zinc diacrylate (ZDA), zinc methacrylate, and zinc dimethacrylate (ZDMA), and mixtures thereof. The cross-linking agent must be present in an amount sufficient to cross-link a portion of the chains of polymers in the resilient polymer component. This may be achieved, for example, by altering the type and amount of cross-linking agent, a method well-known to those of ordinary skill in the art.

Suitable formulations for the cover layers of the multilayer golf ball include, but not limited to:

(1) Polyurethanes, such as those prepared from polyols and diisocyanates or polyisocyanates and those disclosed in U.S. Pat. Nos. 5,334,673 and 6,506,851, U.S. patent application Ser. No. 10/194,059 and U.S. Pat. App. Pub. No. 2004/0010096;

(2) Polyureas, such as those disclosed in U.S. Pat. No. 5,484,870, U.S. Pat. App. Pub. 2003/0096936 and 2004/0010096; and (3) Polyurethane-urea hybrids, blends or copolymers comprising urethane or urea segments.

Polyurethane composition comprises the reaction product of at least one polyisocyanate, at least one polyol, and at least one curing agent. Polyurea composition comprises the reaction product of at least one polyisocyanate, at least one polyamine, and at least one curing agent. The curing agent can include, for example, one or more diamines, one or more polyols, or a combination thereof.

Exemplary polyisocyanates include, but are not limited to, 4,4'-diphenylmethane diisocyanate ("MDI"), polymeric MDI, carbodimide-modified liquid MDI, 4,4'-dicyclohexylmethane diisocyanate ("$H_{12}$MDI"), p-phenylene diisocyanate ("PPDI"), toluene diisocyanate ("TDI"), 3,3'-dimethyl-4,4'-biphenylene diisocyanate ("TODI"), isophoronediisocyanate ("IPDI"), hexamethylene diisocyanate ("HDI"), naphthalene diisocyanate ("NDI"); xylene diisocyanate ("XDI"); para-tetramethylxylene diisocyanate ("p-TMXDI"); meta-tetramethylxylene diisocyanate ("m-TMXDI"); ethylene diisocyanate; propylene-1,2-diisocyanate; tetramethylene-1,4-diisocyanate; cyclohexyl diisocyanate; 1,6-hexamethylene-diisocyanate ("HDI"); dodecane-1,12-diisocyanate; cyclobutane-1,3-diisocyanate; cyclohexane-1,3-diisocyanate; cyclohexane-1,4-diisocyanate; 1-isocyanato-3,3,5-trimethyl-5-isocyanatomethylcyclohexane; methyl cyclohexylene diisocyanate; triisocyanate of HDI; triisocyanate of 2,4,4-trimethyl-1,6-hexane diisocyanate ("TMDI"), tetracene diisocyanate, naphthalene diisocyanate, anthracene diisocyanate, and mixtures thereof. Polyisocyanates are known to those of ordinary skill in the art as having more than one isocyanate group, e.g., di-, tri, and tetra-isocyanate. Preferably, the polyisocyanate includes MDI, PPDI, TDI, or a mixture thereof, and more preferably, the polyisocyanate includes MDI. It should be understood that, as used herein, the term "MDI" includes 4,4'-diphenylmethane diisocyanate, polymeric MDI, carbodiimide-modified liquid MDI, and mixtures thereof and, additionally, that the diisocyanate employed may be "low free monomer," understood by one of ordinary skill in the art to have lower levels of "free" monomer isocyanate groups than conventional diisocyanates, i.e., the compositions of the invention typically have less than about 0.1% free monomer groups. Examples of "low free monomer" diisocyanates include, but are not limited to Low Free Monomer MDI, Low Free Monomer TDI, and Low Free Monomer PPDI.

The polyol component of the polyurethane can be polyester polyols. Suitable polyester polyols include, but are not limited to, polyethylene adipate glycol, polybutylene adipate glycol, polyethylene propylene adipate glycol, ortho-phthalate-1,6-hexanediol, and mixtures thereof. The hydrocarbon chain can have saturated or unsaturated bonds, or substituted or unsubstituted aromatic and cyclic groups.

Alternatively, the polyol component can be polycaprolactone polyols. Suitable polycaprolactone polyols include, but are not limited to, 1,6-hexanediol-initiated polycaprolactone, diethylene glycol initiated polycaprolactone, trimethylol propane initiated polycaprolactone, neopentyl glycol initiated polycaprolactone, 1,4-butanediol-initiated polycaprolactone, and mixtures thereof. The hydrocarbon chain can have saturated or unsaturated bonds, or substituted or unsubstituted aromatic and cyclic groups.

Additionally, the polyol component can be polycarbonate polyols. Suitable polycarbonates include, but are not limited to, polyphthalate carbonate. The hydrocarbon chain can have saturated or unsaturated bonds, or substituted or unsubstituted aromatic and cyclic groups.

The polyamine component of the polyurea can be amine-terminated oligomers or polymers preferably having a molecular weight of at least about 200 and at least two primary or secondary amine terminal groups per molecule. Because lower molecular weight amine-terminated polymers may be prone to forming solids, a high molecular weight between about 1,000 and about 5,000 is more preferred. Suitable examples of amine-terminated oligomers or polymers include, but are not limited to: (a) amine-terminated polyethers, (b) amine-terminated polymers, (c) amine-terminated polycaprolactones, (d) amine-terminated polycarbonates, (e) amine-terminated polyhydrocarbons, (f) amine-terminated acid functional polymers, (g) amine-terminated polyolefins, (h) amine-terminated polyamides, (i) amine-terminated polyacrylics, and any combination thereof.

Suitable examples of amine-terminated polyethers include, but are not limited to polyoxyalkylene diamines, polyoxyethylene diamines, polyoxypropylene diamines, polyoxypropylene triamine, poly(tetramethylene ether) diamines, (ethylene oxide)-capped polyoxypropylene ether diamines, poly(triethyleneglycol) diamines, poly(trimethylolpropane) triamines, polyethyleneglycol-di(p-aminobenzoate), polytetramethyleneoxide-di(p-aminobenzoate), glycerin-based triamines, and the like.

Examples of other amine-terminated polymers, such as amine-terminated polyesters, amine-terminated polycaprolactones, amine-terminated polycarbonates, amine-terminated polyhydrocarbons, amine-terminated acid functional polymers, amine-terminated polyolefins, amine-terminated polyamides, and amine-terminated polyacrylics, preferably can be prepared from the above-listed hydroxyl-terminated polymers using methods described in U.S. Pat. App. Publication 2002/0132915 by Pantone et al., which is incorporated by reference in its entirety. These methods include, for example, (1) reductive amination of polyether polyols with ammonia and hydrogen in the presence of a catalyst (U.S. Pat. Nos. 5,015,773, 5,003,107, and 3,654,370), (2) hydrogenation of cyanoethylated polyols, (3) amination of polyol/sulfonic acid esters (U.S. Pat. No. 3,236,895), (4) reacting polyols with epichlorohydrin and a primary amine, or (5) those listed in the publication "Jeffamine, Polyoxypropylene Amines" by Texaco Chemical Co., 1978.

The curing agent may include a polyol curing agent. Suitable polyol curing agents include, but are not limited to, ethylene glycol, diethylene glycol, polyethylene glycol, polyethylene propylene glycol, polypropylene glycol, lower molecular weight polytetramethylene ether glycol, 1,3-bis (2-hydroxyethoxy) benzene, 1,3-bis-[2-(2-hydroxyethoxy) ethoxy]benzene, 1,3-bis-{2-[2-(2-hydroxyethoxy)ethoxy] ethoxy}benzene, 1,4-butanediol, 1,5-pentanediol, 1,6-hexanediol, resorcinol-di-(β-hydroxyethyl) ether, hydroquinone-di-(β-hydroxyethyl) ether, trimethylol propane, or mixtures thereof.

Polyamine curatives are also suitable for use in the curing agent of the polyurethane composition and have been found to improve cut, shear, and impact resistance of the resultant balls. Preferred polyamine curatives include, but are not limited to, 3,5-dimethylthio-2,4-toluenediamine and isomers thereof; 3,5-diethyltoluene-2,4-diamine and isomers thereof, such as 3,5-diethyltoluene-2,6-diamine; 4,4'-bis-(sec-butylamino)-diphenylmethane; 1,4-bis-(sec-butylamino)-benzene; 4,4'-methylene-bis-(2-chloroaniline); 4,4'-methylene-bis-(3-chloro-2,6-diethylaniline); polytetramethyleneoxide-di-p-aminobenzoate; N,N'-dialkyldiamino diphenyl methane; p,p'-methylene dianiline ("MDA"); m-phenylenediamine ("MPDA"); 4,4'-methylene-bis-(2-chloroaniline) ("MOCA"); 4,4'-methylene-bis-(2,6-diethylaniline); 4,4'-diamino-3,3'-diethyl-5,5'-dimethyl diphenylmethane; 2,2',3,3'-tetrachloro diamino diphenylmethane; 4,4'-methylene-bis-(3-chloro-2,6-diethylaniline); trimethylene glycol di-p-aminobenzoate; and mixtures thereof. Preferably, the curing agent of the present invention includes 3,5-dimethylthio-2,4-toluenediamine and isomers thereof, such as ETHACURE 300. Suitable polyamine curatives, which include both primary and secondary amines, preferably have weight average molecular weights ranging from about 64 to about 2000.

Other than in the operating examples, or unless otherwise expressly specified, all of the numerical ranges, amounts, values and percentages such as those for amounts of materials, and others in the specification may be read as if prefaced by the word "about" even though the term "about" may not expressly appear with the value, amount or range. Accordingly, unless indicated to the contrary, the numerical parameters set forth in the specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contain certain errors necessarily resulting from the standard deviation found in their respective testing measurements. Furthermore, when numerical ranges of varying scope are set forth herein, it is contemplated that any combination of these values inclusive of the recited values may be used.

While it is apparent that the illustrative embodiments of the invention disclosed herein fulfill the preferred embodiments of the present invention, it is appreciated that numerous modifications and other embodiments may be devised by those skilled in the art. Examples of such modifications include slight variations of the numerical values discussed above. Hence, the numerical values stated above and claimed below specifically include those values and the values that are approximately or nearly close to the stated and claimed values. Therefore, it will be understood that the appended claims are intended to cover all such modifications and embodiments, which would come within the spirit and scope of the present invention.

What is claimed is:

1. A multi-layer golf ball comprising at least two adjacent layers, wherein one of the layers comprises a plurality of metal material susceptors, wherein the susceptors improve the adhesion between the at least two adjacent layers when exposed to induction heating, and wherein the susceptors are contained in a layer with non-uniform thickness having a plurality of outer projections disposed on the outer surface of said layer.

2. A multi-layer golf ball comprising at least two adjacent layers, wherein one of the layers comprises a plurality of metal material susceptors, wherein the susceptors improve the adhesion between the at least two adjacent layers when exposed to induction heating, wherein the susceptors are contained in a layer with non-uniform thickness having a plurality of outer projections disposed on the outer surface of said layer, and wherein a profile of the outer projections is selected from the group consisting of trapezoidal, sinusoidal, dome, dome, stepped, cylindrical, conical, truncated conical, rectangular, pyramidal with polygonal base, truncated pyramidal, and polyhedronal.

* * * * *